US009893478B2

(12) United States Patent
Komoto et al.

(10) Patent No.: US 9,893,478 B2
(45) Date of Patent: Feb. 13, 2018

(54) SLIDE CONNECTOR FOR ELECTRICALLY CONNECTING MODULE TO WEARABLE DEVICE

(71) Applicant: Japan Aviation Electronics Industry, Limited, Tokyo (JP)

(72) Inventors: Tetsuya Komoto, Tokyo (JP); Keisuke Nakamura, Tokyo (JP); Akihiro Matsunaga, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 15/397,151

(22) Filed: Jan. 3, 2017

(65) Prior Publication Data

US 2017/0279230 A1 Sep. 28, 2017

(30) Foreign Application Priority Data

Mar. 28, 2016 (JP) ..... 2016-063468

(51) Int. Cl.

| | |
|---|---|
| ***H01R 12/00*** | (2006.01) |
| ***H01R 24/00*** | (2011.01) |
| ***H01R 13/73*** | (2006.01) |
| ***H01R 24/86*** | (2011.01) |
| ***A41D 1/00*** | (2006.01) |
| ***H01R 13/24*** | (2006.01) |

(Continued)

(52) U.S. Cl.

CPC ..... *H01R 24/005* (2013.01); *A41D 1/005* (2013.01); *H01R 13/2442* (2013.01); *H01R 13/625* (2013.01); *H01R 13/665* (2013.01); *H01R 13/73* (2013.01); *H01R 24/86* (2013.01); *H01R 12/613* (2013.01); *H01R 2107/00* (2013.01)

(58) Field of Classification Search

CPC .... H01R 9/096; H01R 23/725; H01R 13/639; H01R 23/7068; H01R 23/7073; H01R 23/6873; H01R 13/2442

USPC .... 439/65, 74, 347, 629, 637, 660, 670, 862

See application file for complete search history.

(56) References Cited

U.S. PATENT DOCUMENTS

| | | | |
|---|---|---|---|
| 6,346,886 | B1 | 2/2002 | De la Huerga |
| 6,895,261 | B1 | 5/2005 | Palamides |

(Continued)

FOREIGN PATENT DOCUMENTS

| | | | |
|---|---|---|---|
| JP | 2015-135723 | A | 7/2015 |

*Primary Examiner* — Thanh Tam Le

(74) *Attorney, Agent, or Firm* — Muncy, Geissler, Olds & Lowe, P.C.

(57) ABSTRACT

A slide connector has a garment-side connector portion and a module-side connector portion to be fitted with the garment-side connector portion in a fitting plane. The garment-side connector portion includes first contact portions each having a contact surface parallel to the fitting plane and at least one locking portion having a locking surface parallel to the fitting plane. The module-side connector portion includes second contact portions each elastically movable and at least one portion to be locked extending in parallel to the fitting plane. As the module-side connector portion is superimposed on the garment-side connector portion and slid along the fitting plane, each second contact portion comes into contact with the contact surface of a corresponding first contact portion to establish electrical connection, and the at least one portion to be locked comes into contact with the locking surface of the at least one locking portion.

7 Claims, 9 Drawing Sheets

(51) Int. Cl.

| | |
|---|---|
| ***H01R 13/625*** | (2006.01) |
| ***H01R 13/66*** | (2006.01) |
| *H01R 107/00* | (2006.01) |
| *H01R 12/61* | (2011.01) |

(56) References Cited

U.S. PATENT DOCUMENTS

| | | | | |
|---|---|---|---|---|
| 7,674,114 | B2 * | 3/2010 | Tanaka | H01R 12/57 439/74 |
| 7,726,994 | B1 | 6/2010 | Willey | |
| 8,137,114 | B1 * | 3/2012 | Peng | H01R 12/716 439/660 |
| 8,439,689 | B2 * | 5/2013 | Niitsu | H01R 12/65 439/65 |
| 8,465,325 | B1 * | 6/2013 | Chan | G06K 13/0806 439/630 |
| 8,632,345 | B2 * | 1/2014 | Shibata | H01R 12/52 439/74 |
| 8,821,178 | B2 * | 9/2014 | Fukui | H01R 4/48 439/342 |
| 8,998,624 | B2 * | 4/2015 | Ida | H01R 13/40 439/74 |
| 9,219,338 | B2 * | 12/2015 | Sagayama | H01R 24/005 |
| 9,252,515 | B2 * | 2/2016 | Komoto | H01R 12/716 |
| 9,293,846 | B2 * | 3/2016 | Komoto | H01R 12/716 |
| 9,318,820 | B2 * | 4/2016 | Niitsu | H01R 12/79 |
| 9,614,321 | B2 * | 4/2017 | Nakamura | H01R 13/6205 |
| 9,647,364 | B2 * | 5/2017 | Komoto | H01R 12/721 |
| 2007/0026695 | A1 | 2/2007 | Lee et al. | |
| 2014/0336493 | A1 | 11/2014 | Kulach et al. | |

* cited by examiner

SLIDE CONNECTOR FOR ELECTRICALLY CONNECTING MODULE TO WEARABLE DEVICE

BACKGROUND OF THE INVENTION

The present invention relates to a slide connector, and particularly to a slide connector that is to be connected to a wearable device.

In recent years, so-called wearable devices, in which terminal devices such as various sensors and communication devices operate as being worn by a user, have attracted attention. Such a wearable device is electrically connected to a device like a measuring device or a power source to be used to transmit detected information or to receive power supply. While the electrical connection can be established via a connector attached to a garment, the connection via a connector has to be disconnected, for example, when the wearable device is removed and when the garment is washed.

Accordingly, as disclosed in JP 2015-135723 A, a snap button connector has been used to establish connection between devices.

As illustrated in FIG. 31, a snap button connector disclosed in JP 2015-135723 A includes a male snap button 2 attached to a first cloth 1 and a female snap button 4 attached to a second cloth 3. The first cloth 1 and the second cloth 3 are made from conductive cloth, while the male snap button 2 and the female snap button 4 are formed of a conductive material. As a convex portion 5 of the male snap button 2 is inserted into a concave portion 6 of the female snap button 4 and pressed down by two bar-like springs 7 of the female snap button 4, the male snap button 2 and the female snap button 4 are electrically connected to each other, whereby the first cloth 1 and the second cloth 3 are electrically connected to each other via the male snap button 2 and the female snap button 4.

Electrical connection of the wearable device can be made using a snap button connector of this type, and when the wearable device is removed or the garment is washed, for example, the electrical connection via the snap button connector can be disconnected by detachment of the male snap button 2 from the female snap button 4.

In the snap button connector of JP 2015-135723 A, however, since each of the male snap button 2 and the female snap button 4 functions entirely as a single electrode, connection of a plurality of wires would require as many snap button connectors as the number of the wires to be attached to a garment, leading to failure of miniaturization of a wearable device.

In addition, while the connector that electrically connects the first cloth 1 to the second cloth 3 needs to be thin, the snap button connector of JP 2015-135723 A has a configuration in which the convex portion 5 of the male snap button 2 is fitted in the concave portion 6 of the female snap button 4 in a direction orthogonal to a surface of the garment and thus is disadvantageous for reduction in thickness.

Moreover, for electrical connection between the first cloth 1 and the second cloth 3, it is required to strongly push either the male snap button 2 or the female snap button 4 down to the wearer's body from above the garment. This gives stress on the body, being inconvenient.

SUMMARY OF THE INVENTION

The present invention has been made in order to solve the conventional problem described above and is aimed at providing a slide connector that can achieve miniaturization of a wearable device, make the device thinner, and reduce stress on a wearer's body at the time of connection of the connector.

A slide connector according to the invention includes a garment-side connector portion to be attached to a garment and a module-side connector portion to be fitted with the garment-side connector portion in a fitting plane, wherein the garment-side connector portion includes a garment-side connector body in a plate shape extending along the fitting plane, a plurality of first contact portions each in a plate shape and each having a contact surface parallel to the fitting plane, the plurality of first contact portions being arranged in the garment-side connector body, and at least one locking portion having a locking surface parallel to the fitting plane, wherein the module-side connector portion includes a plurality of second contact portions each elastically movable in a direction orthogonal to the fitting plane, the plurality of second contact portions corresponding to the plurality of first contact portions of the garment-side connector portion, and at least one portion to be locked extending in parallel to the fitting plane, and wherein, as the module-side connector portion is superimposed on the garment-side connector portion and slid along the fitting plane from a first position to a second position, each of the plurality of second contact portions comes into contact with the contact surface of a corresponding first contact portion to establish electrical connection, and the at least one portion to be locked comes into contact with the locking surface of the at least one locking portion, whereby the module-side connector portion is fitted with the garment-side connector portion.

DETAILED DESCRIPTION OF THE INVENTION

Embodiments of the present invention are described below based on the appended drawings.

Embodiment 1

Figure 1:
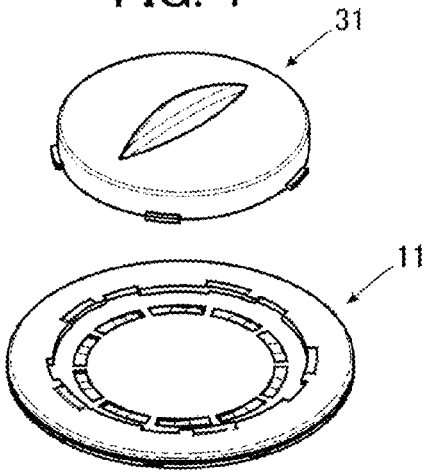
FIG. 1 is a perspective view showing a slide connector according to Embodiment 1 before fitting.

FIG. 1 illustrates a structure of a slide connector according to Embodiment 1. The slide connector includes a garment-side connector portion 11 to be attached to a garment and a module-side connector portion 31 to be fitted with the garment-side connector portion 11.

Figure 2A:
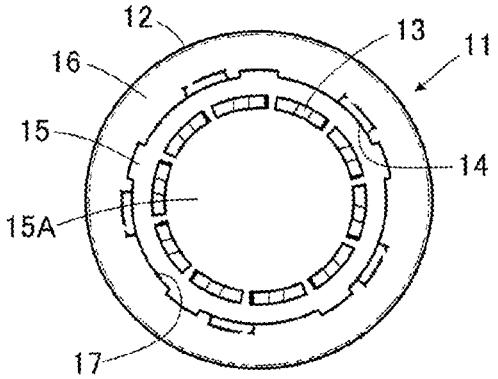
FIGS. 2A to 2C are a plan view, a side view and a bottom view, respectively, each showing a garment-side connector portion used in the slide connector according to Embodiment 1.
Figure 2C:
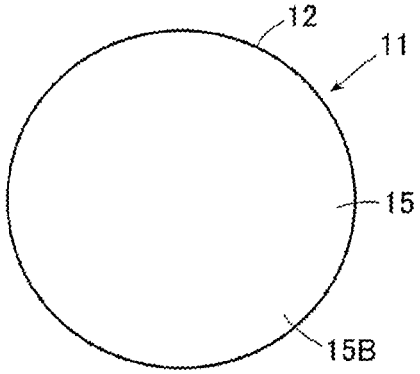
Figure 2B:
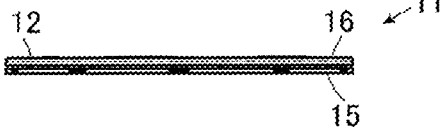

As illustrated in FIGS. 2A to 2C, the garment-side connector portion 11 includes a garment-side connector body 12 in a circular plate shape, a plurality of first contact portions 13 arranged in the garment-side connector body 12, and a plurality of locking portions 14 formed in the garment-side connector body 12.

The garment-side connector body 12 is composed of a base member 15 in a circular plate shape and a frame member 16 attached to an outer periphery of a front surface 15A of the base member 15. The frame member 16 has a circular frame shape with an opening portion 17 provided at its center, and the plurality of first contact portions 13 are arranged so as to be each partially exposed above the front surface 15A of the base member 15 through the opening portion 17 of the frame member 16 but not to be exposed to a rear surface 15B of the base member 15. In addition, the plurality of locking portions 14 are located on an outer periphery side of the garment-side connector portion 11 in relation to the plurality of first contact portions 13 and arranged in a circumferential direction along an inner circumferential edge of the frame member 16.

Figure 3:
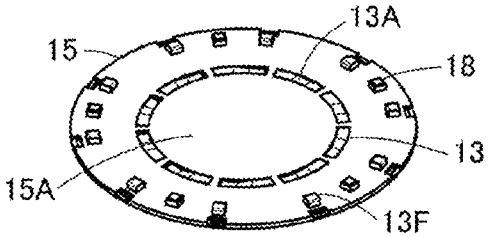
FIG. 3 is a perspective view showing a base member of the garment-side connector portion in Embodiment 1.
Figure 4:
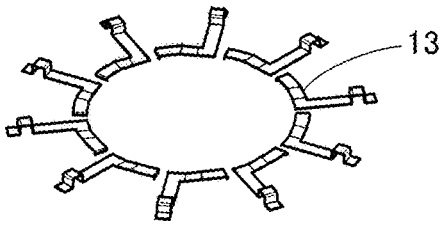
FIG. 4 is a perspective view showing a plurality of first contact portions held by the base member of the garment-side connector portion in Embodiment 1.
Figure 5A:
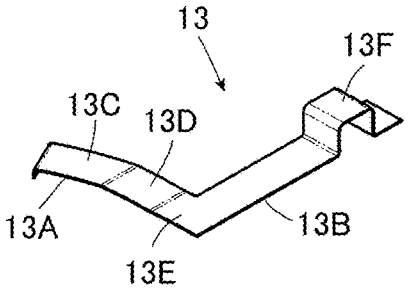
FIGS. 5A and 5B are an enlarged perspective view and an enlarged side view, respectively, each showing the first contact portion.

The base member 15 is shown in FIG. 3. The first contact portions 13 are arranged and held in the base member 15 in the circumferential direction so as to form a circle as illustrated in FIG. 4. Each of the first contact portions 13 includes a circumferentially extending portion 13A extending along the circumferential direction of the base member 15 and a radially extending portion 13B connected to the circumferentially extending portion 13A and extending along the radial direction of the base member 15, as illustrated in FIG. 5A. At one end surface of the circumferentially extending portion 13A, a contact surface 13C is formed, and an inclined surface 13D is continuously connected to the contact surface 13C, whereas at the other end of the circumferentially extending portion 13A, a flat surface 13E is formed and continuously connected to the inclined surface 13D.

The radially extending portion 13B is connected to the other end of the above-described circumferentially extending portion 13A. The radially extending portion 13B extends from the other end of the circumferentially extending portion 13A along the radial direction of the base member 15 and is provided at its end with an external connection portion 13F in a bending shape.

Figure 5B:
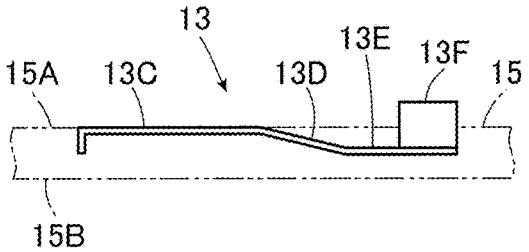

As illustrated in FIG. 5B, the contact surface 13C is parallel to the front surface 15A of the base member 15 and has a substantially same height as that of the front surface 15A of the base member 15; the inclined surface 13D that is continuous with the contact surface 13C is inclined toward a rear surface 15B of the base member 15 so as to lower as advancing from the contact surface 13C to the flat surface 13E; and the flat surface 13E that is continuous with the inclined surface 13D is parallel to the front surface 15A of the base member 15 and is positioned on the rear surface 15B side to be lower than the front surface 15A of the base member 15. In addition, the external connection portion 13F is positioned at a higher height than that of the front surface 15A of the base member 15.

As illustrated in FIG. 3, the circumferentially extending portion 13A of each of the first contact portions 13 is exposed above the front surface 15A of the base member 15 to form an exposed portion through the opening portion 17 of the frame member 16 shown in FIG. 2A. In addition, as illustrated in FIG. 3, the external connection portion 13F of each of the first contact portions 13 protrudes from the front surface 15A and is exposed in the vicinity of the outer periphery of the front surface 15A of the base member 15, whereas the radially extending portion 13B except the external connection portion 13F is buried in the base member 15 and not exposed to the front surface 15A of the base member 15.

Moreover, a plurality of protrusions 18 protruding from the front surface 15A of the base member 15 are formed in the vicinity of the outer periphery of the front surface 15A of the base member 15, and the external connection portions 13F of the first contact portions 13 and the protrusions 18 are located so as to be covered by the frame member 16 when the frame member 16 is attached to the base member 15.

Figure 6:
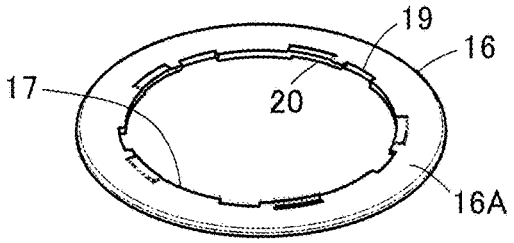
FIG. 6 is a perspective view showing a frame member of the garment-side connector portion in Embodiment 1.
Figure 7:
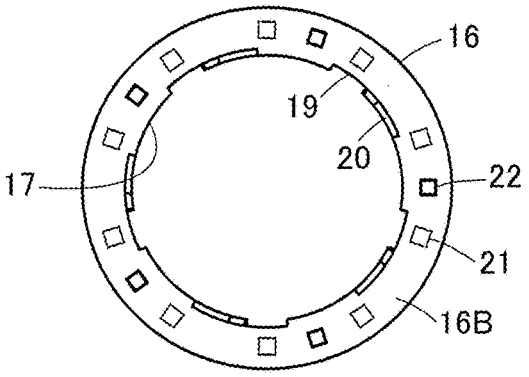
FIG. 7 is a bottom view showing the frame member of the garment-side connector portion in Embodiment 1.

As illustrated in FIGS. 6 and 7, the frame member 16 is provided with a plurality of notches 19 that are arranged along the inner circumferential edge of the frame member 16 along the circumferential direction and open toward the opening portion 17. Each of the notches 19 is formed across the thickness direction of the frame member 16 from a front surface 16A to a rear surface 16B. The rear surface 16B of the frame member 16 is provided with a plurality of locking surfaces 20 at positions adjacent to the notches 19, respectively, along the circumferential direction. The locking surfaces 20 are arranged at the inner circumferential edge of the frame member 16 along the circumferential direction, located in parallel to the front surface 16A of the frame member 16 and on the front surface 16A side rather than the rear surface 16B side, and face toward the rear surface 16B of the frame member 16.

In addition, the rear surface 16B of the frame member 16 is provided with a plurality of first fitting holes 21 and a plurality of second fitting holes 22, the first fitting holes 21 respectively corresponding to the external connection portions 13F of the first contact portions 13 protruding from the front surface 15A of the base member 15, and the second fitting holes 22 respectively corresponding to the protrusions 18 protruding from the front surface 15A of the base member 15.

The base member 15 configured as described above can be integrally formed with the first contact portions 13 through the insert-molding using an insulation resin, for example. The frame member 16 can also be formed from an insulation resin.

Figure 8:
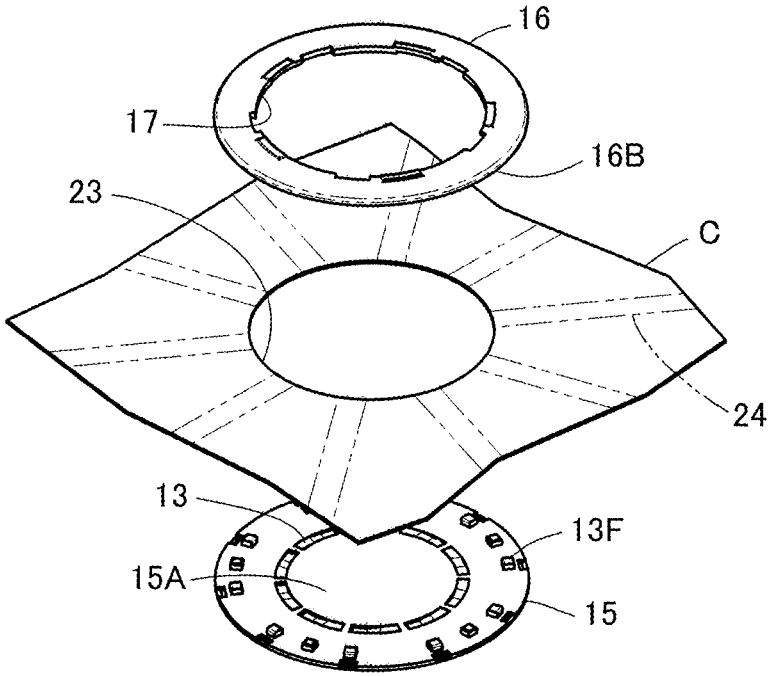
FIG. 8 is a perspective view showing the base member and the frame member of the garment-side connector portion in Embodiment 1 as being attached to cloth of a garment.

As illustrated in FIG. 8, the frame member 16 is attached to the base member 15 as sandwiching cloth C of a garment between the base member 15 and the frame member 16. The cloth C is preliminarily provided with an opening portion 23 in a similar size to the opening portion 17 of the frame member 16 and provided, on the rear surface of the cloth C, with a plurality of wiring portions 24 corresponding to the plurality of first contact portions 13, and the wiring portions 24 are connected to a wearable device (not shown) that is attached to a garment. The wiring portions 24 are arranged around the opening portion 23 such that one end of each of the wiring portions 24 overlaps the corresponding external connection portion 13F of the base member 15 when the front surface 15A of the base member 15 is brought into contact with the rear surface of the cloth C.

The front surface 15A of the base member 15 is brought into contact with the rear surface of the cloth C, and the base member 15 is aligned to the frame member 16 such that one end of each of the wiring portions 24 of the cloth C comes into contact with the corresponding external connection portion 13F of the base member 15, the rear surface 16B of the frame member 16 is brought into contact with the front surface of the cloth C, and in this state, the frame member 16 is firmly pressed to the base member 15. In this manner, the external connection portions 13F and the protrusions 18 of the base member 15 respectively fit into the first fitting holes 21 and the second fitting holes 22 of the frame member 16 with the cloth C being sandwiched between the base member 15 and the frame member 16, whereby the garment-side connector portion 11 is attached to the cloth C.

In this process, each of the wiring portions 24 of the cloth C is pressed into the corresponding first fitting hole 21 of the frame member 16 while being in contact with the corresponding external connection portion 13F of the base member 15 and is electrically connected to the external connection portion 13F.

Figure 9:
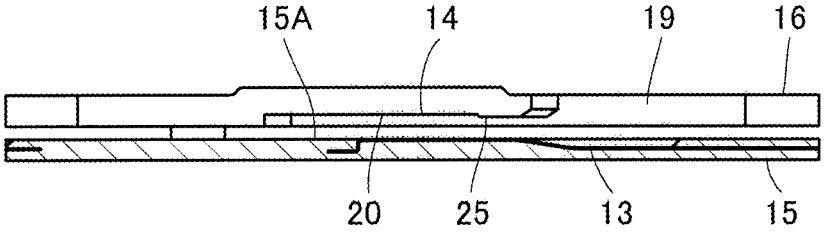
FIG. 9 is an enlarged partial cross-sectional view showing the garment-side connector portion in Embodiment 1.

In addition, the locking surfaces 20 of the frame member 16 face the front surface 15A of the base member 15 via the opening portion 23 of the cloth C, and, as illustrated in FIG. 9, the locking portion 14 is formed between each of the locking surfaces 20 of the frame member 16 and the front surface 15A of the base member 15.

The locking surface 20 has, at an end portion thereof adjacent to the corresponding notch 19, a step 25 that slightly projects toward the rear surface 16B of the frame member 16, i.e., on the base member 15 side.

Figure 10:
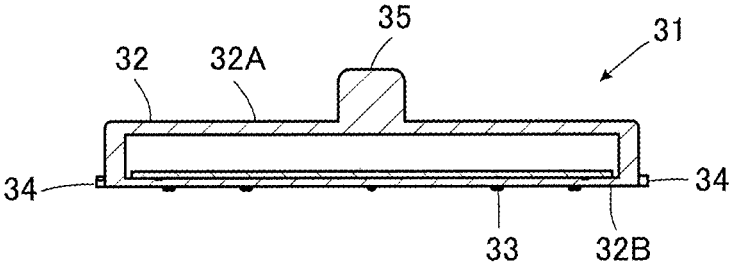
FIG. 10 is a cross-sectional view showing a module-side connector portion in Embodiment 1.
Figure 11:
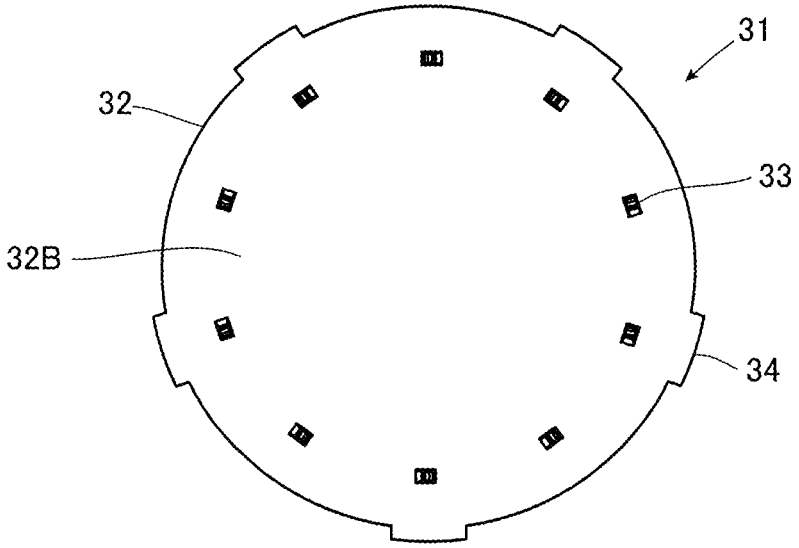
FIG. 11 is a bottom view showing the module-side connector portion in Embodiment 1.

The module-side connector portion 31 is shown in FIGS. 10 and 11. The module-side connector portion 31 includes a module-side connector body 32 in a circular box shape, a plurality of spring-like second contact portions 33 projecting from a rear surface 32B of the module-side connector body 32, and a plurality of plate-shaped portions to be locked 34 projecting from the outer circumferential portion of the module-side connector body 32 in the radial direction along the rear surface 32B of the module-side connector body 32.

The second contact portions 33 are arranged in the circumferential direction of the module-side connector body 32 so as to form a circle and correspond to the first contact portions 13 of the garment-side connector portion 11 and are each formed to be elastically movable in a direction orthogonal to the rear surface 32B of the module-side connector body 32.

In addition, the portions to be locked 34 correspond to the locking portions 14 of the garment-side connector portion 11 and also to the notches 19.

The portions to be locked 34 are arranged on an outer periphery side of the module-side connector portion 31 in relation to the second contact portions 33.

In addition, the front surface 32A of the module-side connector body 32 is provided with a tab 35 used to rotate the module-side connector portion 31 on the garment-side connector portion 11.

The module-side connector body 32 in a box shape accommodates therein a circuit module to be connected to a wearable device (not shown) attached to a garment, for example.

In the garment-side connector portion 11, the first contact portions 13, the locking portions 14, the opening portion 17 of the frame member 16 and the notches 19 are all arranged in a concentric fashion, while in the module-side connector portion 31, the circular outer periphery of the module-side connector body 32, the second contact portions 33 and the portions to be locked 34 are all arranged in a concentric fashion. In addition, a circle along which the first contact portions 13 of the garment-side connector portion 11 are arranged is set to have a diameter value same as that of a circle along which the second contact portions 33 of the module-side connector portion 31 are arranged.

The slide connector is configured such that, as being inserted in the opening portion 17 of the frame member 16 of the garment-side connector portion 11, the module-side connector portion 31 can be rotated and slid about the center of the concentric circle of the garment-side connector portion 11.

Figure 12:
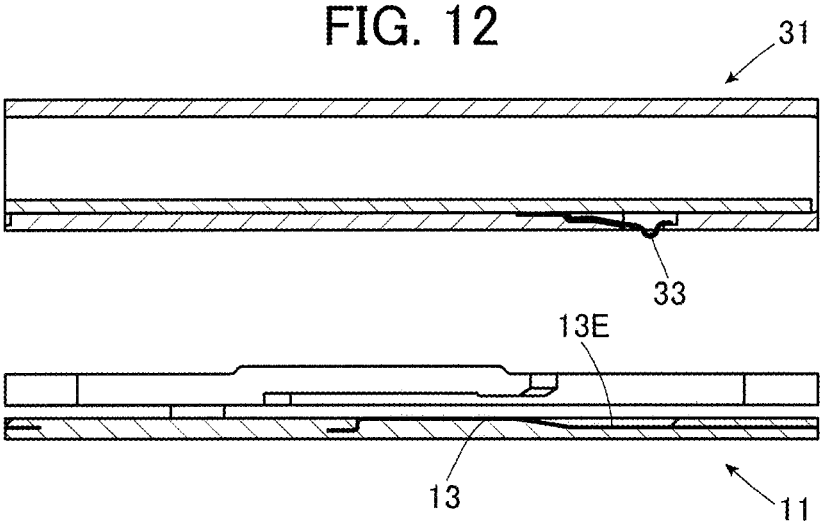
FIG. 12 is a partial cross-sectional view showing the module-side connector portion and the garment-side connector portion aligned to each other in Embodiment 1.

For fitting the module-side connector portion 31 with the garment-side connector portion 11, the module-side connector portion 31 is aligned to the garment-side connector portion 11 such that the portions to be locked 34 of the module-side connector portion 31 are located directly above the notches 19 of the garment-side connector portion 11. In this manner, each of the spring-like second contact portions 33 of the module-side connector portion 31 is located directly above the flat surface 13E of the corresponding first contact portion 13 of the garment-side connector portion 11, as illustrated in FIG. 12.

Figure 13:
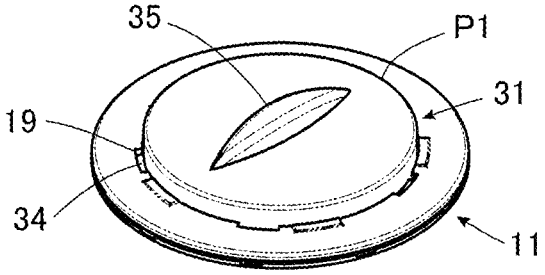
FIG. 13 is a perspective view showing the module-side connector portion superimposed on the garment-side connector portion in Embodiment 1.
Figure 14:
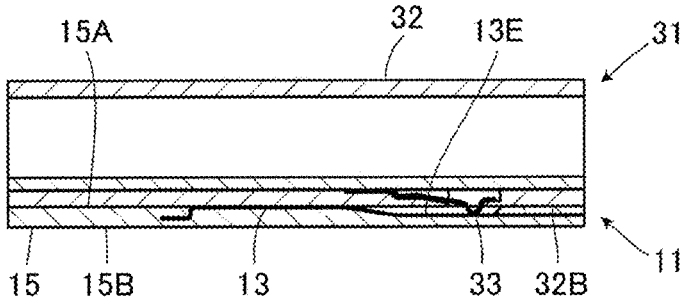
FIG. 14 is a partial cross-sectional view showing a positional relation between the first contact portion and a second contact portion when the module-side connector portion is superimposed on the garment-side connector portion in Embodiment 1.

Subsequently, the module-side connector portion 31 is moved and superimposed on the garment-side connector portion 11, and as illustrated in FIG. 13, the notches 19 of the garment-side connector portion 11 are inserted into the portions to be locked 34 of the module-side connector portion 31. At this time, while the second contact portion 33 of the module-side connector portion 31 projects downward from the rear surface 32B of the module-side connector body 32 as illustrated in FIG. 14, the flat surface 13E of the first contact portion 13 of the garment-side connector portion 11 is positioned on the rear surface 15B side to be lower than the front surface 15A of the base member 15. Accordingly, the second contact portion 33 of the module-side connector portion 31 is close to but not in contact with the flat surface 13E of the first contact portion 13 of the garment-side connector portion 11, or even if in contact with the flat surface 13E of the first contact portion 13, the second contact portion 33 contacts so lightly as not to elastically deform.

Figure 15:
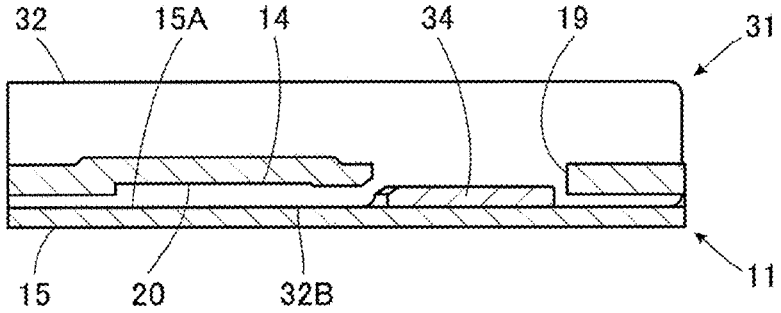
FIG. 15 is a partial cross-sectional view showing a positional relation between a locking portion and a portion to be locked when the module-side connector portion is superimposed on the garment-side connector portion in Embodiment 1.

Moreover, as illustrated in FIG. 15, the portion to be locked 34 of the module-side connector portion 31 is inserted in the notch 19 of the garment-side connector portion 11, and the rear surface 32B of the module-side connector body 32 comes into contact with the front surface 15A of the base member 15 of the garment-side connector portion 11.

The rear surface 32B of the module-side connector body 32 and the front surface 15A of the base member 15 each forms a fitting plane when the garment-side connector portion 11 is fitted with the module-side connector portion 31.

The rotation position of the module-side connector portion 31 when the portions to be locked 34 of the module-side connector portion 31 are inserted in the notches 19 of the garment-side connector portion 11 in this manner is defined as a first position P1, as illustrated in FIG. 13.

Figure 16:
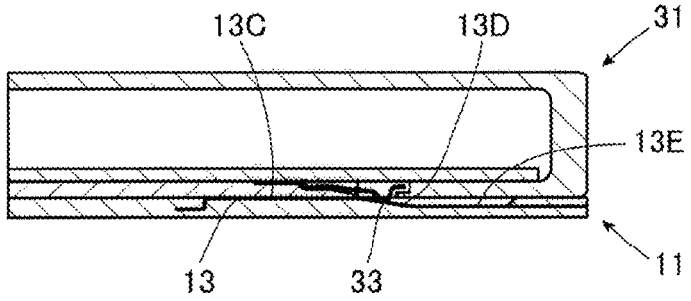
FIG. 16 is a partial cross-sectional view showing a positional relation between the first contact portion and the second contact portion when the module-side connector portion is rotated and slid on the garment-side connector portion in Embodiment 1.

Starting from the state where the module-side connector portion 31 is located at the first position P1, the tab 35 of the module-side connector portion 31 is operated to rotate and slide the module-side connector portion 31 on the garment-side connector portion 11 along the fitting plane, whereby each of the spring-like second contact portions 33 of the module-side connector portion 31 moves from the position directly above the flat surface 13E of the corresponding first contact portion 13 of the garment-side connector portion 11 toward the inclined surface 13D of the first contact portion 13. Subsequently, as illustrated in FIG. 16, as the spring-like second contact portion 33 of the module-side connector portion 31 reaches to a position above the inclined surface 13D of the first contact portion 13 of the garment-side connector portion 11, the spring-like second contact portion 33 comes into contact with the inclined surface 13D of the first contact portion 13 and gradually elastically deforms since the inclined surface 13D is inclined so as to rise upward as advancing from the flat surface 13E to the contact surface 13C.

Figure 17:
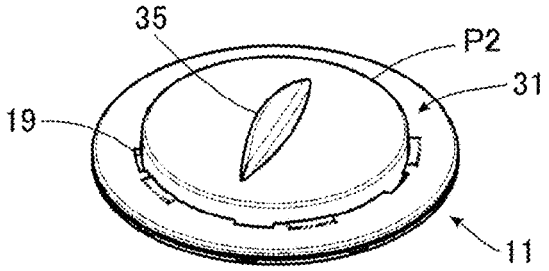
FIG. 17 is a perspective view showing the slide connector according to Embodiment 1 at a time of fitting.
Figure 18:
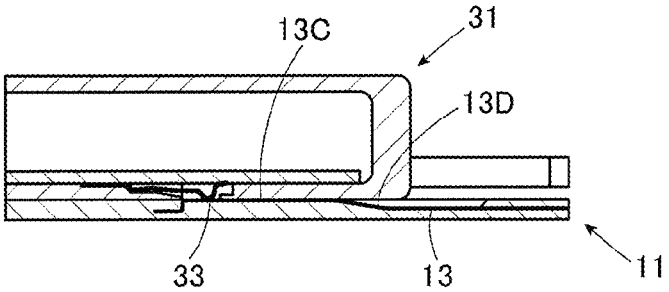
FIG. 18 is a partial cross-sectional view showing a positional relation between the first contact portion and the second contact portion at the time of fitting in Embodiment 1.

Furthermore, as the tab 35 of the module-side connector portion 31 is operated to rotate and slide the module-side connector portion 31 to a second position P2 as illustrated in FIG. 17, the spring-like second contact portion 33 of the module-side connector portion 31 moves from the inclined surface 13D to the contact surface 13C on the first contact portion 13 of the garment-side connector portion 11 as illustrated in FIG. 18 and elastically deforms to come into contact with the contact surface 13C of the first contact portion 13 at a predetermined contact pressure. In this manner, the first contact portions 13 of the garment-side connector portion 11 are electrically connected to the second contact portions 33 of the module-side connector portion 31, and the fitting state between the garment-side connector portion 11 and the module-side connector portion 31 is achieved.

Figure 19:
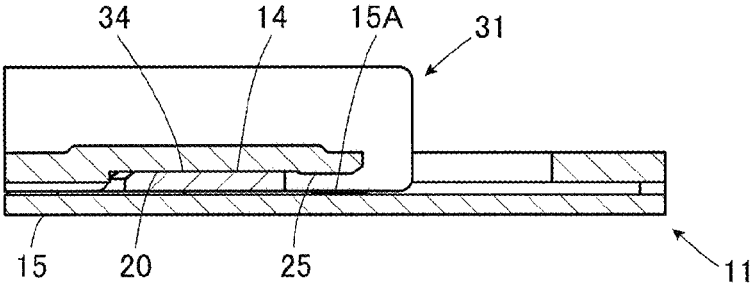
FIG. 19 is a partial cross-sectional view showing a positional relation between the locking portion and the portion to be locked at the time of fitting in Embodiment 1.

In addition, when the module-side connector portion 31 is positioned at the position P2, the portion to be locked 34 of the module-side connector portion 31 is inserted in the locking portion 14 formed between the locking surface 20 of the garment-side connector portion 11 and the front surface 15A of the base member 15, as illustrated in FIG. 19. In this manner, the module-side connector portion 31 is prevented from falling off in a direction away from the garment-side connector portion 11, and the fitting state is locked.

At this time, the portion to be locked 34 of the module-side connector portion 31 is inserted deeper than the step 25 of the locking surface 20 and is pressed toward the locking surface 20 by the reaction force of elastic deformation of the second contact portions 33. Hence, even if the module-side connector portion 31 fitted with the garment-side connector portion 11 is rotated to return from the second position P2 to the first position P1, the portion to be locked 34 is stuck with the step 25 of the locking surface 20, whereby the locking state is maintained.

The garment-side connector portion 11 and the module-side connector portion 31 may be released from the fitting state by pressing the module-side connector portion 31 against the garment-side connector portion 11, having the portion to be locked 34 on the side of the front surface 15A of the base member 15 away from the step 25 of the locking surface 20, and rotating and sliding the module-side connector portion 31 to the first position P1.

Accordingly, as the module-side connector portion 31 is simply superimposed on the garment-side connector portion 11 and rotated and slid from the first position P1 to the second position P2 along the fitting plane, the spring-like second contact portions 33 of the module-side connector portion 31 come into contact with the plate-shaped first contact portions 13 of the garment-side connector portion 11, respectively, to establish electrical connection, and the portions to be locked 34 of the module-side connector portion 31 come into contact with the locking surfaces 20 of the locking portions 14 of the garment-side connector portion 11, whereby the module-side connector portion 31 can be fitted with the garment-side connector portion 11. Therefore, a wearable device can be miniaturized and thinned, and besides the need to firmly press a snap button toward a wearer's body from above the garment in a conventional snap button connector can be removed, whereby stress on a wearer's body when the connector is connected can be reduced.

In addition, since each of the first contact portions 13 of the garment-side connector portion 11 has the inclined surface 13D continuous with the contact surface 13C, when the garment-side connector portion 11 is fitted with the module-side connector portion 31, the corresponding second contact portion 33 of the module-side connector portion 31 comes into contact with the contact surface 13C as wiping the inclined surface 13D of the first contact portion 13 of the garment-side connector portion 11. Accordingly, a possible connection failure between the first contact portion 13 and the second contact portion 33 due to a foreign object present therebetween can be effectively prevented.

Embodiment 2

In Embodiment 1 above, the spring-like second contact portions 33 of the module-side connector portion 31 each project from the rear surface 32B of the module-side connector body 32, while the contact surfaces 13C of the first contact portions 13 of the garment-side connector portion 11 each have a substantially same height as that of the front surfaces 15A of the base member 15, and the flat surfaces 13E are positioned on the rear surface 15B side to be lower than the front surface 15A of the base member 15. However, the invention is not limited thereto.

Figure 20:
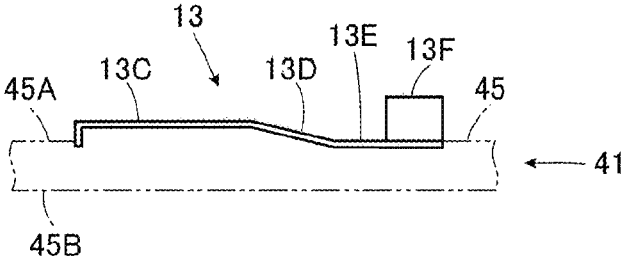
FIG. 20 is an enlarged side view showing a first contact portion of a garment-side connector portion of a slide connector according to Embodiment 2.

FIG. 20 shows a first contact portion 13 of a garment-side connector portion 41 of a slide connector according to Embodiment 2. The first contact portion 13 is same as that used in Embodiment 1 but has a contact surface 13C at a position higher than a front surface 45A of a base member 45, an inclined surface 13D continuous with the contact surface 13C inclined so as to lower as advancing from the contact surface 13C to a flat surface 13E, and the flat surface 13E continuous with the inclined surface 13D at a height almost same as that of the front surface 45A of the base member 45.

Except the difference in the positional height of the first contact portion 13 with respect to the base member 45 as described above, the garment-side connector portion 41 has the same structure as that of the garment-side connector portion 11 in Embodiment 1.

Figure 21:
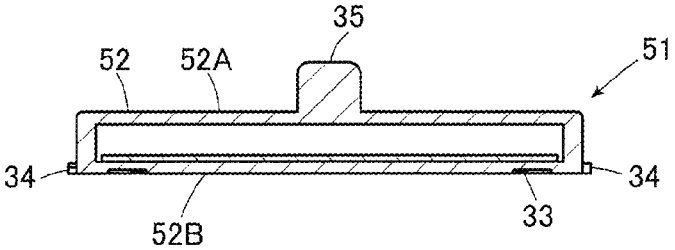
FIG. 21 is a cross-sectional view showing a module-side connector portion of the slide connector according to Embodiment 2.
Figure 22:
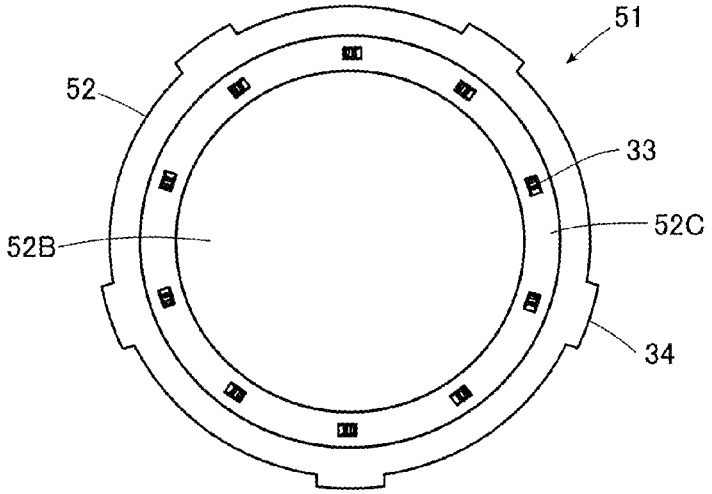
FIG. 22 is a bottom view showing the module-side connector portion of the slide connector according to Embodiment 2.

In a module-side connector portion 51 of the slide connector according to Embodiment 2, as illustrated in FIGS. 21 and 22, an annular groove 52C is formed on a rear surface 52B of a module-side connector body 52, a plurality of spring-like second contact portions 33 are arranged in the groove 52C at a height at which the spring-like second contact portions 33 protrude from the bottom surface of the groove 52C but do not protrude from the rear surface 52B of the module-side connector body 52.

Except the fact that the module-side connector body 52 has the groove 52C as well as the positional height of the second contact portions 33 with respect to the module-side connector body 52, the module-side connector portion 51 has the same structure as that of the module-side connector portion 31 in Embodiment 1.

Figure 23:
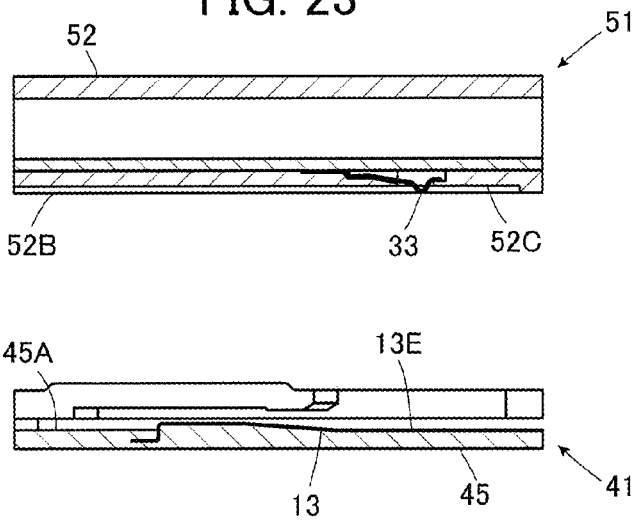
FIG. 23 is a partial cross-sectional view showing the module-side connector portion and the garment-side connector portion aligned to each other in Embodiment 2.

For fitting the module-side connector portion 51 with the garment-side connector portion 41, the garment-side connector portion 41 and the module-side connector portion 51 are first aligned. In this manner, each of the spring-like second contact portions 33 of the module-side connector portion 51 is located directly above the flat surface 13E of the corresponding first contact portion 13 of the garment-side connector portion 41, as illustrated in FIG. 23.

Figure 24:
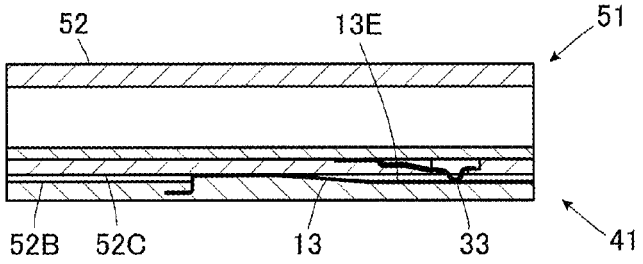
FIG. 24 is a partial cross-sectional view showing a positional relation between the first contact portion and a second contact portion when the module-side connector portion is superimposed on the garment-side connector portion in Embodiment 2.

Then, the module-side connector portion 51 is moved and superimposed on the garment-side connector portion 41. At this time, the contact surface 13C of the first contact portion 13 is inserted in the groove 52C of the module-side connector body 52, and the flat surface 13E of the first contact portion 13 is positioned at the almost same height as that of the front surface 45A of the base member 45 as illustrated in FIG. 24. In the meantime, since the second contact portion 33 of the module-side connector portion 51 does not protrude downward from the rear surface 52B of the module-side connector body 52, the second contact portion 33 is close to but not in contact with the flat surface 13E of the first contact portion 13, or even if in contact with the flat surface 13E of the first contact portion 13, the second contact portion 33 contacts so slightly as not to elastically deform.

Figure 25:
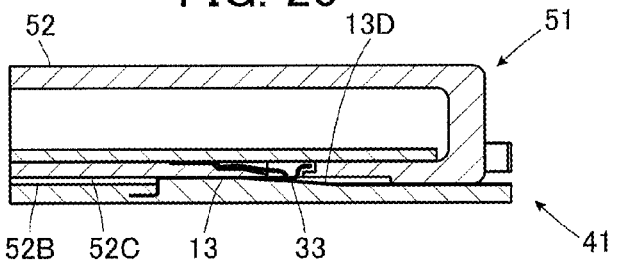
FIG. 25 is a partial cross-sectional view showing a positional relation between the first contact portion and the second contact portion when the module-side connector portion is rotated and slid on the garment-side connector portion in Embodiment 2.

When the module-side connector portion 51 is rotated and slid on the garment-side connector portion 41 along the fitting plane, as illustrated in FIG. 25, as the spring-like second contact portion 33 of the module-side connector portion 51 reaches to a position above the inclined surface 13D of the first contact portion 13 of the garment-side connector portion 41, the spring-like second contact portion 33 comes into contact with the inclined surface 13D of the first contact portion 13 and gradually elastically deforms since the inclined surface 13D is inclined so as to rise upward as advancing from the flat surface 13E to the contact surface 13C.

Figure 26:
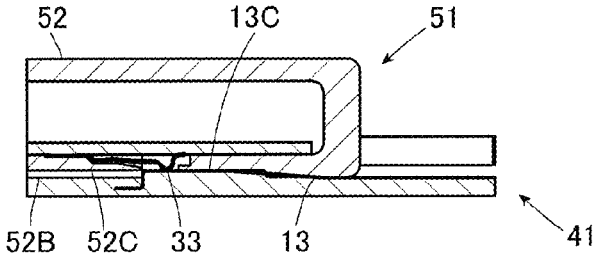
FIG. 26 is a partial cross-sectional view showing a positional relation between the first contact portion and the second contact portion at a time of fitting in Embodiment 2.

Furthermore, as the module-side connector portion 51 is rotated and slid, as illustrated in FIG. 26, the spring-like second contact portion 33 of the module-side connector portion 51 moves from the inclined surface 13D to the contact surface 13C of the first contact portion 13 of the garment-side connector portion 41 and elastically deforms to come into contact with the contact surface 13C of the first contact portion 13 at a predetermined contact pressure. In this manner, the first contact portions 13 of the garment-side connector portion 41 are electrically connected to the second contact portions 33 of the module-side connector portion 51, and the fitting state between the garment-side connector portion 41 and the module-side connector portion 51 is achieved.

In this manner, even if the connector according to the invention is configured such that the spring-like second contact portions 33 of the module-side connector portion 51 do not project from the rear surface 52B of the module-side connector body 52, similarly to Embodiment 1, the module-side connector portion 51 can be fitted with the garment-side connector portion 41 by mere rotation and sliding of the module-side connector portion 51 on the garment-side connector portion 41, a wearable device can be miniaturized and thinned, and at the same time, the burden on a wearer's body at the time of connection of the connector can be reduced.

In Embodiments 1 and 2 described above, the number of the first contact portions 13 and the number of the second contact portions 33 are not limited to the numbers shown in the drawings and can be any number as long as they are each plural.

In addition, in Embodiments 1 and 2, while the first contact portions 13 and the second contact portions 33 are arranged so as to form a circle, they may be arranged so as to form an arc which is a part of a circle.

Embodiment 3

In Embodiments 1 and 2 described above, the module-side connector portion 31 or 51 is rotated and slid on the garment-side connector portion 11 or 41 to be fitted. However, the invention is not limited thereto.

Figure 27:
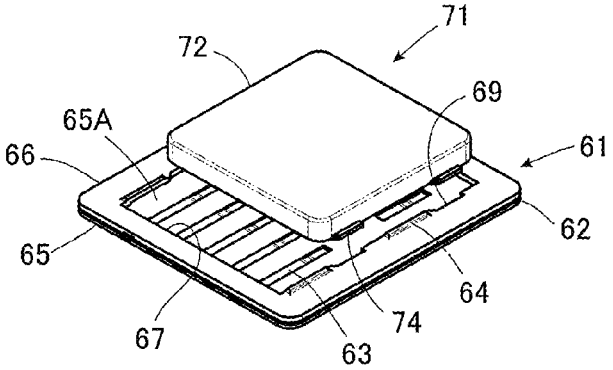
FIG. 27 is a perspective view showing a slide connector according to Embodiment 3 before fitting.

FIG. 27 illustrates a structure of a slide connector according to Embodiment 3. The slide connector includes a garment-side connector portion 61 to be attached to a garment and a module-side connector portion 71 to be linearly slid on the garment-side connector portion 61 to be fitted.

The garment-side connector portion 61 includes a rectangular garment-side connector body 62, a plurality of plate-like first contact portions 63 arranged linearly on the garment-side connector body 62, and a plurality of locking portions 64 formed in the garment-side connector body 62.

The garment-side connector body 62 is composed of a base member 65 in a rectangular plate shape and a frame member 66 in a rectangular frame shape attached to an outer periphery of a front surface 65A of the base member 65. The frame member 66 is provided with a rectangular opening portion 67 at its center, and the plurality of first contact portions 63 are each partially exposed above the front surface 65A of the base member 65 through the opening portion 67 of the frame member 66. In addition, the locking portions 64 are located on an outer periphery side of the garment-side connector portion 61 in relation to the first contact portions 63 and arranged along an inner circumferential edge of the frame member 66.

Similarly to the first contact portions 13 in Embodiment 1, each of the first contact portions 63 has a contact surface, an inclined surface continuous with the contact surface and a flat surface continuous with the inclined surface, and the contact surface, the inclined surface and the flat surface are exposed above the front surface 65A of the base member 65. In addition, the first contact portion 63 has an external connection portion protruding to the outer periphery of the front surface 65A of the base member 65 and covered by the frame member 66.

The frame member 66 is provided with a plurality of notches 69 that open toward the opening portion 67, and a locking surface (not shown) is formed in the vicinity of each of the notches 69.

The module-side connector portion 71 includes a module-side connector body 72 in a rectangular box shape, a plurality of spring-like second contact portions (not shown) projecting from a rear surface of the module-side connector body 72, and a plurality of plate-like portions to be locked 74 projecting laterally from the module-side connector body 72.

The second contact portions (not shown) are arranged so as to correspond to the first contact portions 63 of the garment-side connector portion 61 and are each formed to be movable in a direction orthogonal to the rear surface of the module-side connector body 72.

Figure 28:
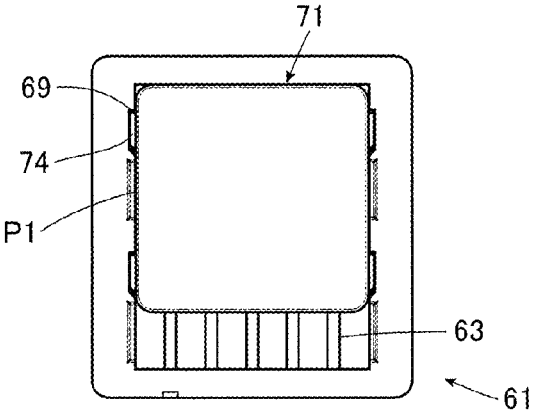
FIG. 28 is a plan view showing a module-side connector portion and a garment-side connector portion superimposed on each other in Embodiment 3.

The module-side connector portion 71 thus structured is superimposed on the garment-side connector portion 61, the notches 69 of the garment-side connector portion 61 are inserted into the portions to be locked 74 of the module-side connector portion 71, and the module-side connector portion 71 is positioned at a first position P1, as illustrated in FIG. 28. At this time, each of the second contact portions of the module-side connector portion 71 faces the flat surface of the corresponding first contact portion 63 of the garment-side connector portion 61 and is not connected to the first contact portion 63 of the garment-side connector portion 61 yet.

Figure 29:
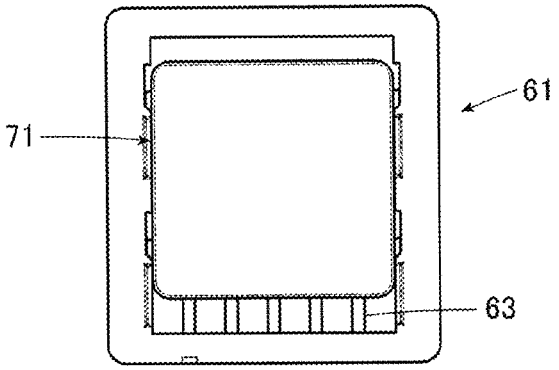
FIG. 29 is a plan view showing the module-side connector portion linearly slid on the garment-side connector portion in Embodiment 3.
Figure 30:
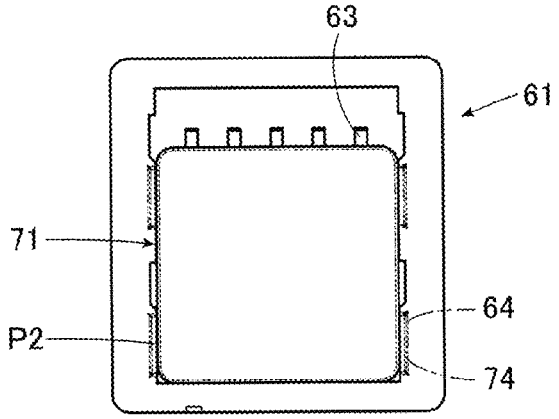
FIG. 30 is a perspective view showing the slide connector according to Embodiment 3 at a time of fitting.
Figure 31:
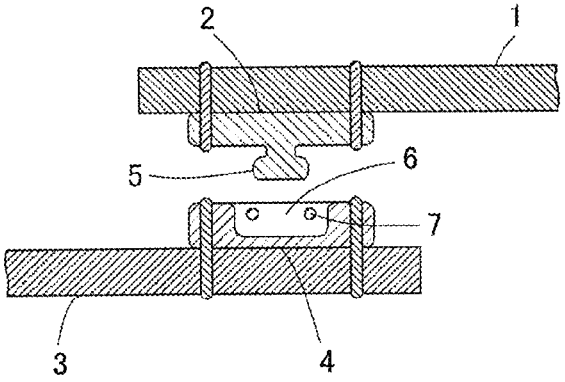
FIG. 31 PRIOR ART
FIG. 31 is a cross-sectional view showing a conventional snap button connector.

As the module-side connector portion 71 is linearly slid on the garment-side connector portion 61 from the first position P1 as illustrated in FIG. 29, each of the spring-like second contact portions of the module-side connector portion 71 moves toward the inclined surface of the corresponding first contact portion 63 of the garment-side connector portion 61. Furthermore, as the module-side connector portion 71 is linearly slid to a second position P2 as illustrated in FIG. 30, each of the spring-like second contact portions of the module-side connector portion 71 elastically deforms and comes into contact with the contact surface of the corresponding first contact portion 63 of the garment-side connector portion 61 at a predetermined contact pressure. In this manner, the first contact portions 63 of the garment-side connector portion 61 are electrically connected to the second contact portions of the module-side connector portion 71, and the fitting state between the garment-side connector portion 61 and the module-side connector portion 71 is achieved.

In addition, when the module-side connector portion 71 is positioned at the second position P2, each of the portions to be locked 74 of the module-side connector portion 71 is inserted in the corresponding locking portion 64 formed between the locking surface of the garment-side connector portion 61 and the front surface 65A of the base member 65, whereby the fitting state between the garment-side connector portion 61 and the module-side connector portion 71 is locked.

In this manner, even if the connector according to the invention is configured such that the module-side connector portion 71 is linearly slid on the garment-side connector portion 61, similarly to Embodiments 1 and 2, the module-side connector portion 71 can be fitted with the garment-side connector portion 61 by mere sliding of the module-side connector portion 71 on the garment-side connector portion 61, a wearable device can be miniaturized and thinned, and at the same time, stress on a wearer's body at the time of connection of the connector can be reduced.

It should be noted that as long as the garment-side connector portion 61 and the module-side connector portion 71 have a plurality of the first contact portions 63 and a plurality of the second contact portions, respectively, the number of the first contact portions 63 and the number of the second contact portions are not limited.

What is claimed is:

1. A slide connector for electrically connecting a module to a wearable device attached to a garment, the slide connector comprising:

a garment-side connector portion to be attached to the garment; and a module-side connector portion to be fitted with the garment-side connector portion in a fitting plane, wherein the garment-side connector portion includes a garment-side connector body in a plate shape extending along the fitting plane, a plurality of first contact portions each in a plate shape and each having a contact surface parallel to the fitting plane, the plurality of first contact portions being arranged in the garment-side connector body, and at least one locking portion having a locking surface parallel to the fitting plane, wherein the module-side connector portion includes a plurality of second contact portions each elastically movable in a direction orthogonal to the fitting plane, the plurality of second contact portions corresponding to the plurality of first contact portions of the garment-side connector portion, and at least one portion to be locked extending in parallel to the fitting plane, and wherein, as the module-side connector portion is superimposed on the garment-side connector portion and slid along the fitting plane from a first position to a second position, each of the plurality of second contact portions comes into contact with the contact surface of a corresponding first contact portion to establish electrical connection, and the at least one portion to be locked comes into contact with the locking surface of the at least one locking portion, whereby the module-side connector portion is fitted with the garment-side connector portion.

2. The slide connector according to claim 1, wherein each of the plurality of first contact portions has an inclined surface that is continuously connected to the contact surface and is inclined in a direction in which the inclined surface recedes more from the module-side connector portion than the contact surface, and wherein the plurality of second contact portions are not in contact with the plurality of first contact portions when the module-side connector portion is positioned at the first position, and as the module-side connector portion is slid in parallel to the fitting plane from the first position to the second position, each of the plurality of second contact portions comes into contact with the inclined surface of a corresponding first contact portion and thereafter moves in a direction orthogonal to the fitting plane to come into contact with the contact surface of the corresponding first contact portion.

3. The slide connector according to claim 1, wherein the at least one locking portion is arranged on an outer periphery side of the garment-side connector portion in relation to the plurality of first contact portions, and wherein the at least one portion to be locked is arranged on an outer periphery side of the module-side connector portion in relation to the plurality of second contact portions.

4. The slide connector according to claim 1, wherein the plurality of first contact portions and the plurality of second contact portions are each arranged in a form of a circle or an arc in a plane parallel to the fitting plane, and wherein, as the module-side connector portion is rotated and slid on the garment-side connector portion around a center of the circle or the arc, the module-side connector portion is fitted with the garment-side connector portion.

5. The slide connector according to claim 1, wherein the plurality of first contact portions and the plurality of second contact portions are each linearly arranged in a plane parallel to the fitting plane, and wherein, as the module-side connector portion is linearly slid on the garment-side connector portion, the module-side connector portion is fitted with the garment-side connector portion.

6. The slide connector according to claim 1, wherein the garment-side connector body includes a base member in a plate shape, the base member having a front surface that constitutes the fitting plane and supporting the plurality of first contact portions such that the contact surface is arranged on the front surface, and a frame member in a frame shape provided with an opening portion at a center of the frame member, the frame member being attached to an outer periphery of the front surface of the base member as sandwiching cloth of the garment between the frame member and the front surface of the base member and being provided with the locking surface facing the front surface of the base member, wherein the contact surface of each of the plurality of first contact portions is exposed through the opening portion of the frame member, wherein the at least one locking portion is formed by the outer periphery of the front surface of the base member and the locking surface, and wherein the module-side connector portion slides along the front surface of the base member in the opening portion of the frame member.

7. The slide connector according to claim 6, wherein each of the plurality of first contact portions has an external connection portion extending to an outer periphery of the base member, wherein the cloth of the garment has a plurality of wires corresponding to the plurality of first contact portions, and wherein, as the cloth of the garment is sandwiched between the front surface of the base member and the frame member, each of the plurality of wires comes into contact with and is electrically connected to the external connection portion of a corresponding first contact portion.

* * * * *